US006044988A

United States Patent [19]

Yang

[11] Patent Number: 6,044,988

[45] Date of Patent: Apr. 4, 2000

[54] FITTING STRUCTURE OF MODULAR RACK

[76] Inventor: Hsin-Chen Yang, 423 Section 2, Tou Yuan Road, Pei Tou Township, Chan Hua Hsien, Taiwan

[21] Appl. No.: 09/305,081

[22] Filed: May 4, 1999

[51] Int. Cl.[7] ..... A47B 57/34; A47B 9/00; A47F 5/14

[52] U.S. Cl. ..... 211/187; 211/182; 108/107; 108/147.13

[58] Field of Search ..... 211/187, 182, 211/181.1; 108/106, 107, 108, 147.12, 147.13, 147.15, 147.17

[56] References Cited

U.S. PATENT DOCUMENTS 4,615,278 10/1986 Cabrelli ..... 108/147.13 X
4,799,818 1/1989 Sudimak et al. ..... 211/187 X
5,676,263 10/1997 Chang ..... 211/187
5,884,567 3/1999 Bartz, Jr. ..... 108/106
5,924,581 7/1999 Chen ..... 211/187

*Primary Examiner*—Daniel P. Stodola
*Assistant Examiner*—Erica B. Harris
*Attorney, Agent, or Firm*—Smith, Gambrell, Russell, LLP

[57] ABSTRACT

A modular rack comprises a plurality of upright support rods and shelves which are supported on various levels of the upright support rods in conjunction with a plurality of locating pieces, sleeves, and retaining pieces. The sleeves are fastened with the upright support rods in conjunction with the locating pieces and are provided with a retaining seat. The retaining pieces are fastened with four comers of the shelves. The shelves are releasably retained at various levels of the upright support rods such that the retaining pieces of the shelves are releasably retained by the retaining seats of the sleeves.

2 Claims, 6 Drawing Sheets

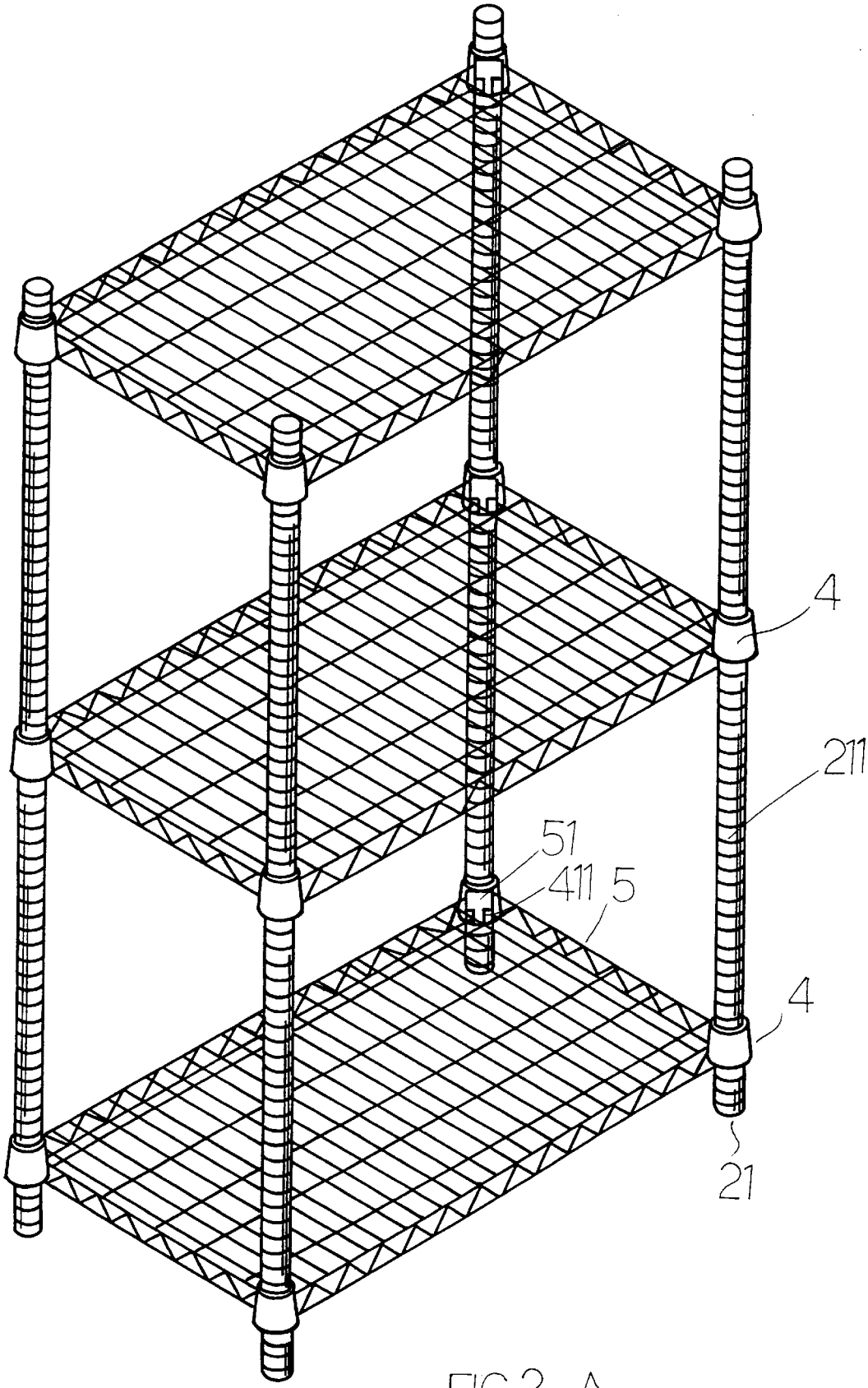
FIG. 2 -A

FITTING STRUCTURE OF MODULAR RACK

FIELD OF THE INVENTION

The present invention relates generally to a modular rack, and more particularly to a fitting structure of the modular rack.

BACKGROUND OF THE INVENTION

As shown in FIG. 1, a prior art modular rack comprises a plurality of upright support rods A1 and shelves A2 which are supported by the upright support rods A1 in conjunction with a plurality of locating pieces A3 and sleeves A21. Each of the upright support rods A1 is provided in the outer surface thereof with a plurality of locating grooves A11 which are arranged at an interval. The locating pieces A3 are provided in the inner wall thereof with a locating rib A31. The locating pieces A3 are located in pair on the upright support rods A1 such that the locating ribs A31 are retained in the locating grooves. Each shelf A2 is provided at four comers thereof with four sleeves A21 and is supported by the upright support rods A1 such that each of the four sleeves A21 is fitted over the locating pieces A3.

Such a prior art modular rack as described above is defective in design in that the entire rack must be dismantled to rearrange the shelves A2, and that the sleeves A21 of the shelves A2 can not be easily separated from the locating pieces A3.

SUMMARY OF THE INVENTION

The primary objective of the present invention is therefore to provide a modular rack which is free from the drawbacks of the prior art modular rack described above.

In keeping with the principle of the present invention, the foregoing objective of the present invention is attained by a modular rack comprising a plurality of upright support rods, and shelves which are supported at an interval by the upright support rods in conjunction with a plurality of locating pieces, sleeves, and retaining pieces. The sleeves are fastened with the upright support rods in conjunction with the locating pieces and are provided with a retaining seat. The retaining pieces are fastened with four comers of the shelves. The shelves are detachably fastened at various levels with the upright support rods such that the retaining pieces of the shelves are retained by the retaining seats of the sleeves. In addition, each sleeve may be provided with two retaining seats fastened therewith such that they form therebetween an angle of 90 degrees.

The foregoing objective, features, functions, and advantages of the present invention will be more readily understood upon a thoughtful deliberation of the following detailed description of the embodiments of the present invention with reference to the accompanying drawings.

BRIEF DESCRIPTION OF THE ERAWINGS

FIG. 2A shows a perspective view of a modular rack of the present invention.

DETAILED DESCRIPTION OF THE EMBODIMENTS

Figure 1:
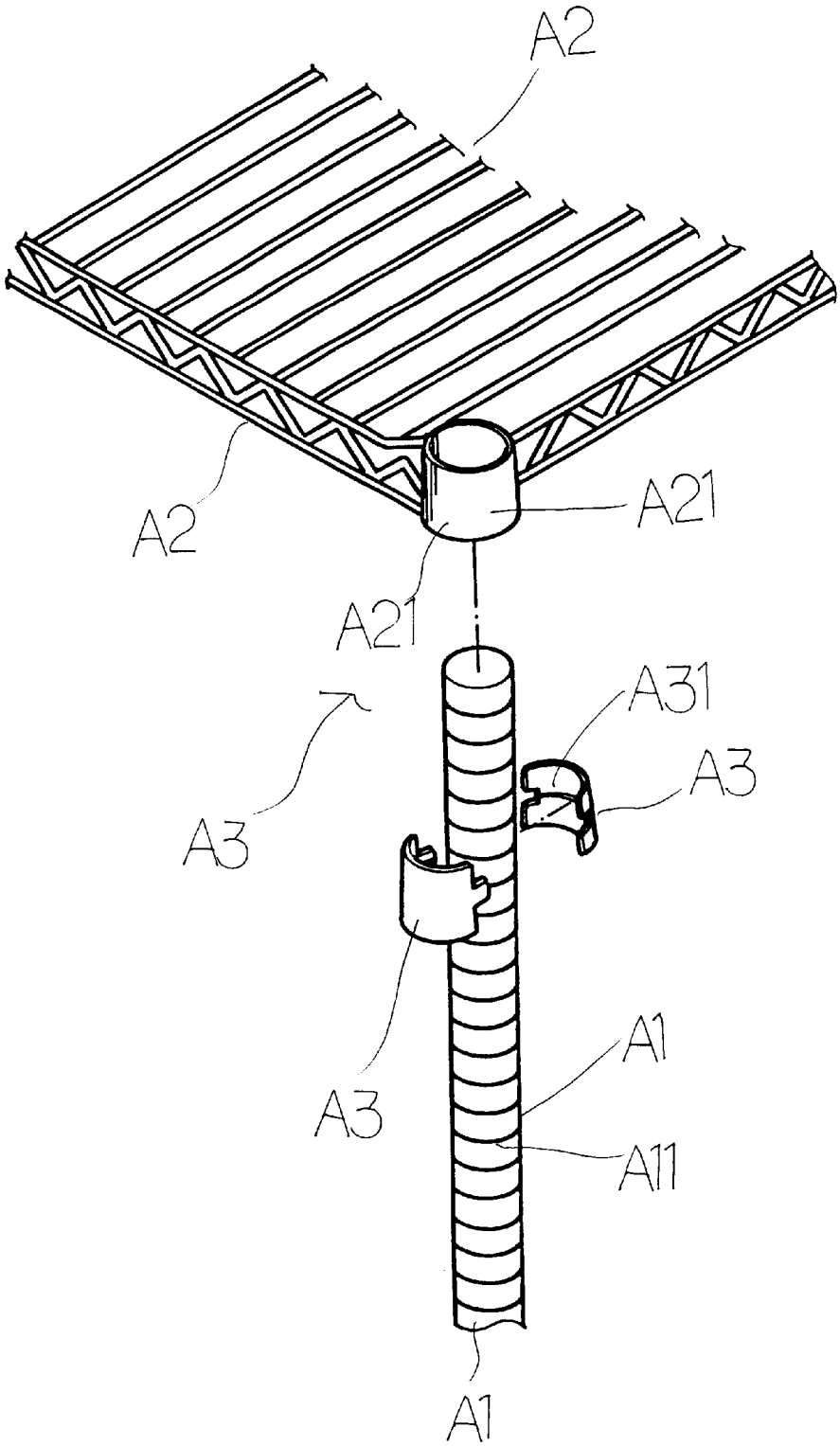
FIG. 1 PRIOR ART
FIG. 1 shows a partial exploded view of a modular rack of the prior art.
Figure 2:
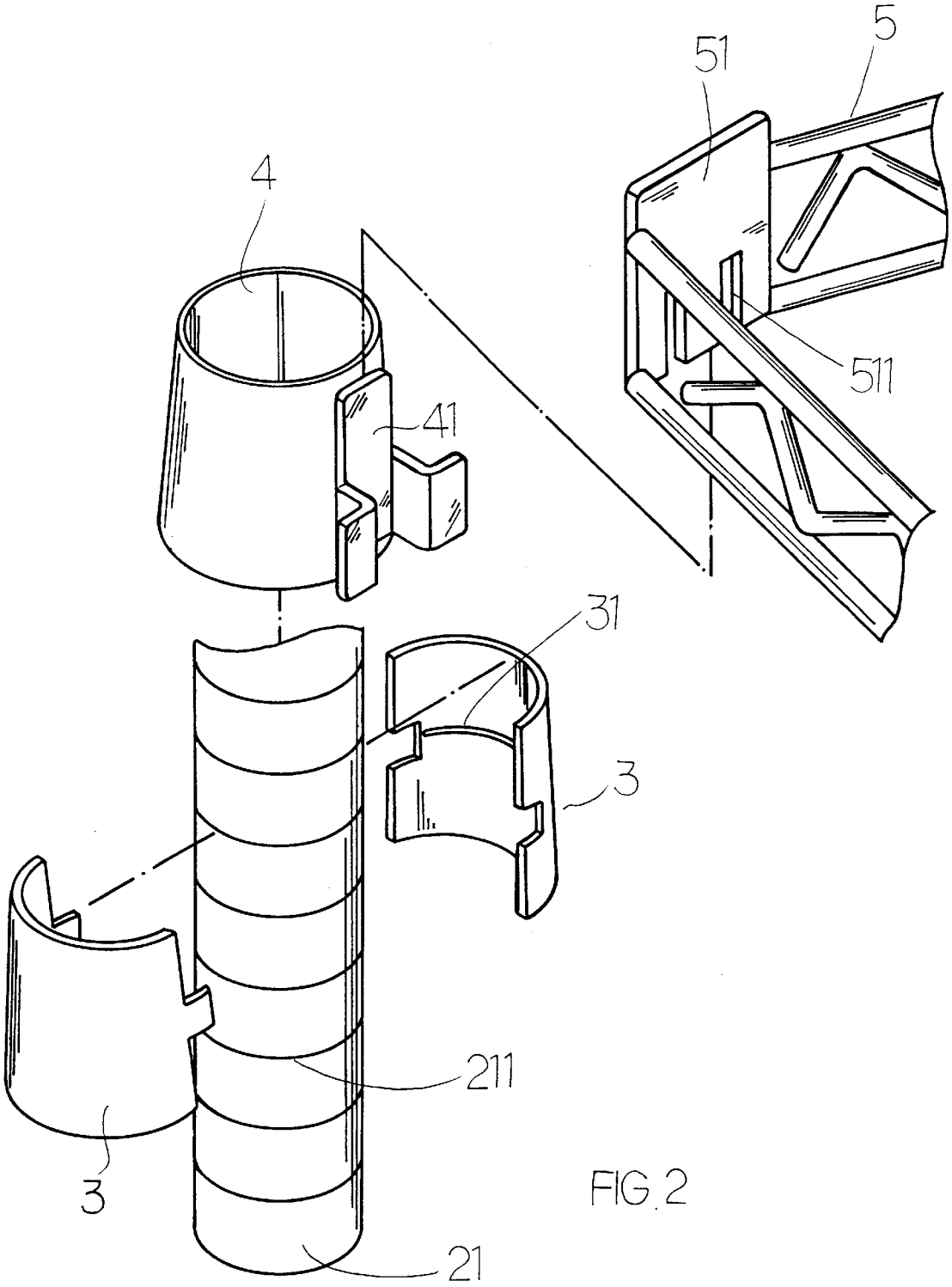
FIG. 2 shows an exploded view of the present invention.
Figure 3:
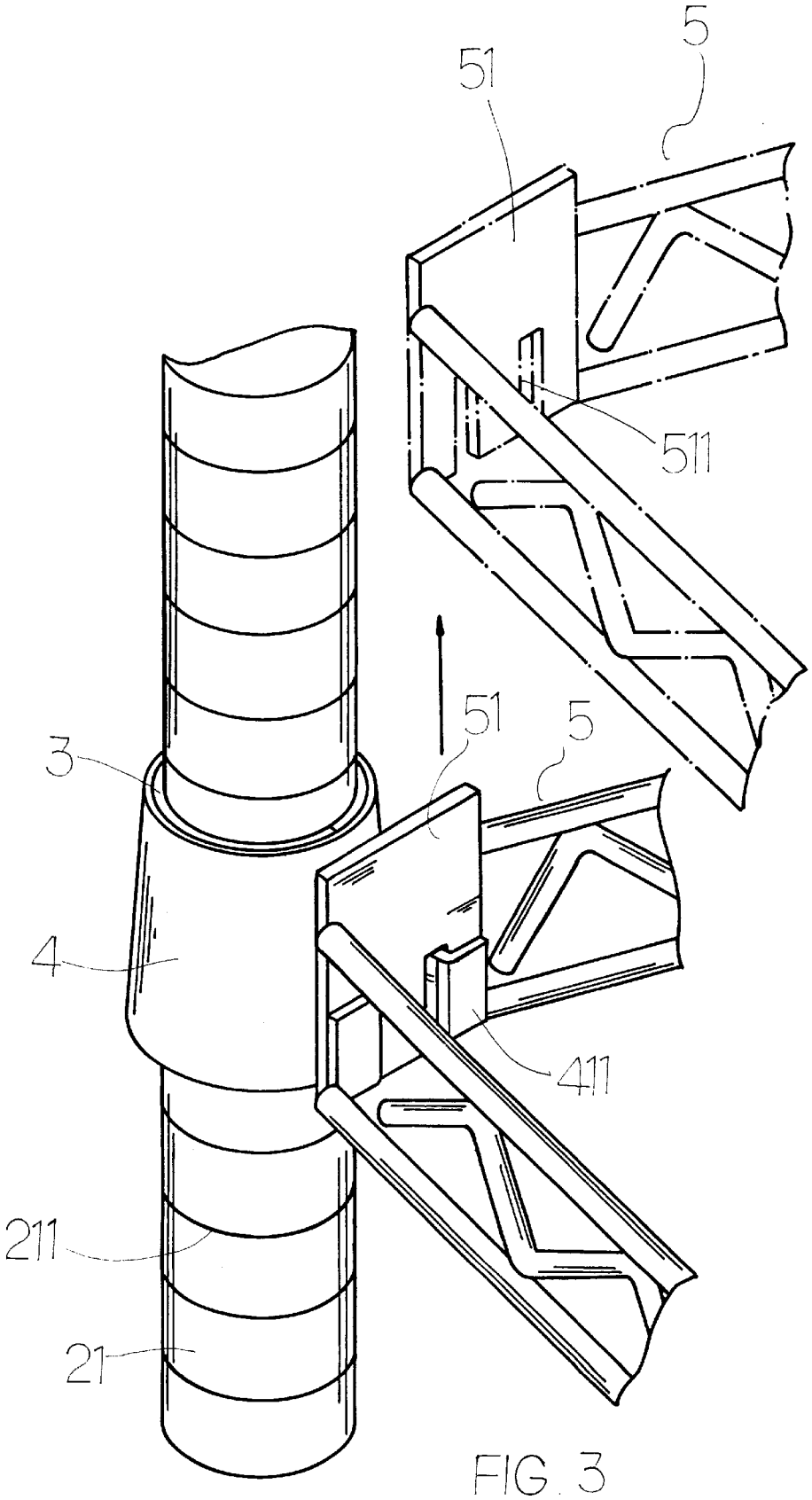
FIG. 3 shows a schematic view of dismantling the modular rack of the present invention.

As shown in FIGS. 2–3, a modular rack embodied in the present invention is formed of a plurality of upright support rods 21 and shelves 5 which are supported at various levels by the upright support rods 21 in conjunction with a plurality of locating pieces 3, sleeves 4, and retaining pieces 51.

The upright support rods 21 are provided in the outer surface thereof with a plurality of locating grooves 211 which are arranged at an interval. The locating pieces 3 are provided in the inner wall thereof with a locating rib 31. Two symmetrical locating pieces 3 are located at a level on the upright support rods 21 such that the ribs 31 of the two locating pieces 3 are retained in the locating groove 211 of the upright support rods 21. The sleeves 4 are of a tapered construction and are provided with a retaining seat 41 which is fastened therewith and provided with two L-shaped retainers 411 opposite in location to each other. Each of the sleeves 4 is located by two locating pieces 3. The shelves 5 are provided at four corners thereof with a retaining piece 51 which is in turn provided with a retaining portion 511. The shelves 5 are supported by the upright support rods 21 such that the retaining portion 511 of each retaining piece 51 of the shelves 5 is retained releasably by the retainers 411 of the retaining seat 41 of the sleeve 4, as illustrated by an arrow in FIG. 3.

Figure 4:
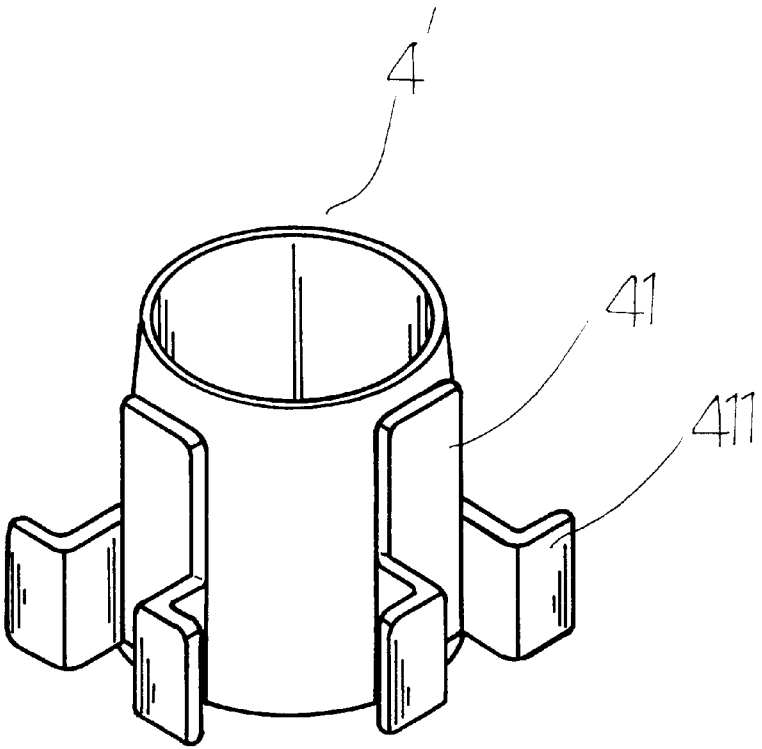
FIG. 4 shows a partial schematic view of a second preferred embodiment of the present invention.
Figure 5:
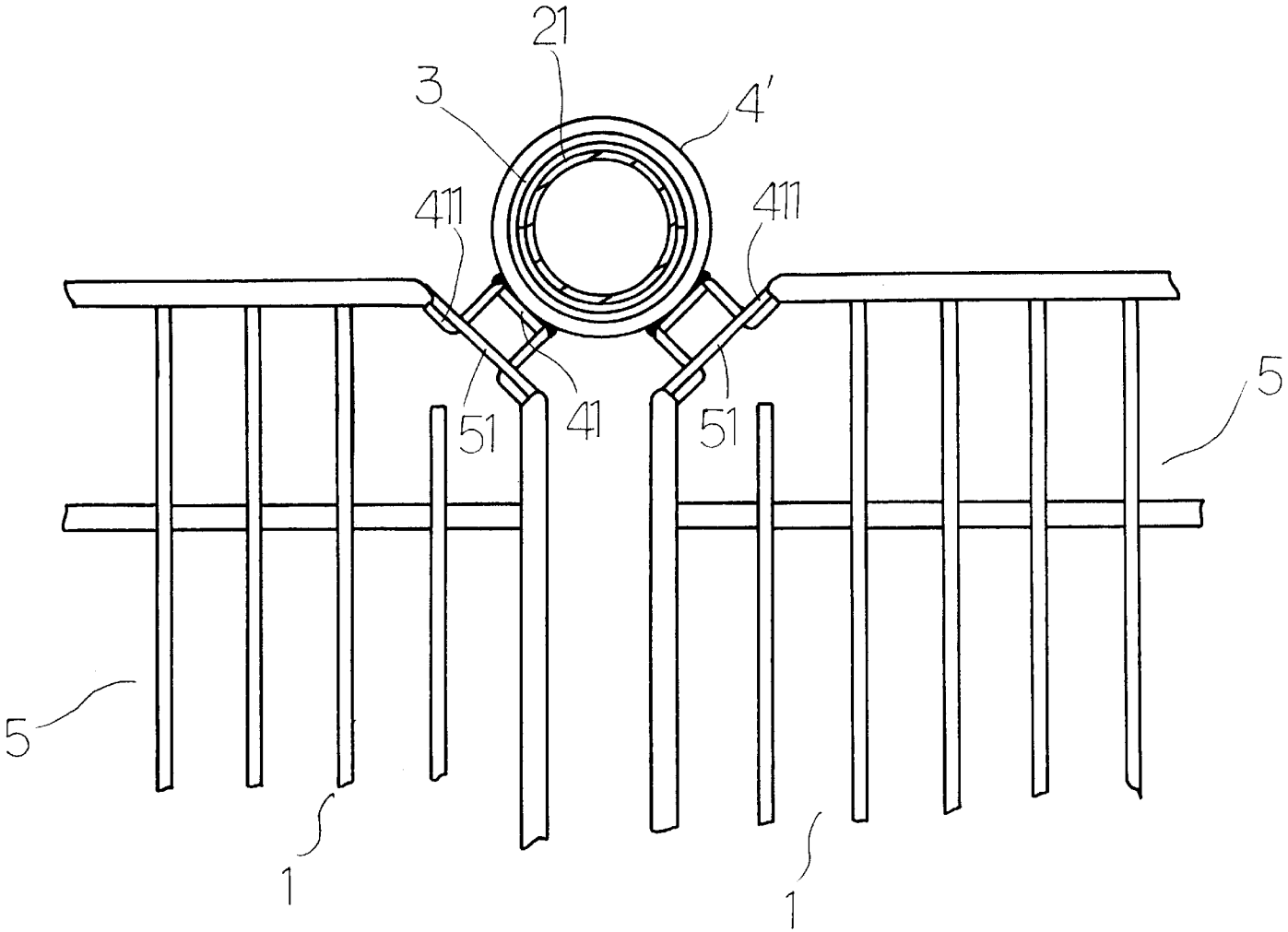
FIG. 5 shows a partial schematic view of the second preferred embodiment of the present invention at work.

As shown in FIGS. 4 and 5, the second preferred embodiment of the present invention is different from the first preferred embodiment of the present invention in design in that the former comprises a plurality of sleeves 4' which are of a tapered construction and are provided with two retaining seats 41' fastened therewith by welding. The two retaining seats 41' are separated from each other by an angle of 90 degrees. The sleeves 4' of the second preferred embodiment of the present invention are intended to facilitate the joining of a plurality of the modular racks 1 side by side, as shown in FIG. 5.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A modular rack comprising:

a plurality of upright support rods provided with a plurality of locating grooves;

a plurality of locating pieces adapted to engage each of said upright support rods, each locating piece having a locating rib that is positioned to be retained by one of the locating grooves of the upright support rods;

a plurality of tapered sleeves, each comprising a retaining seat having two retainers projecting therefrom, each sleeve being positioned on the upright support rod such that the sleeve is fitted over the locating pieces positioned on the locating groove; and a plurality of shelves adapted to be located at any of various levels along the upright support rods, the shelves being provided at four corners thereof with a retaining piece having a retaining portion adapted to releasably receive the retainers of the retaining seat of a tapered sleeve, the sleeve being positioned at any of various levels along the upright support rods by interlocking engagement between the retainers and the retaining portion.

2. The modular rack as defined in claim 1, wherein said sleeve is provided with two retaining seats fastened therewith such that said two retaining seats are separated from each other by an angle of 90 degrees.

* * * * *